United States Patent [19]

Compton et al.

[11] Patent Number: 4,611,728

[45] Date of Patent: Sep. 16, 1986

[54] BAG DISPENSING PACKAGE

[75] Inventors: Stephen F. Compton, Wellford; Richard D. Thomas, Mauldin, both of S.C.

[73] Assignee: W. R. Grace & Co., Cryovac Div., Duncan, S.C.

[21] Appl. No.: 675,480

[22] Filed: Nov. 29, 1984

Related U.S. Application Data

[63] Continuation of Ser. No. 452,359, Dec. 23, 1982, abandoned.

[51] Int. Cl.[4] ..... B65D 25/52

[52] U.S. Cl. ..... 221/63; 221/47

[58] Field of Search ..... 221/33, 63, 47–55, 221/26; 206/554, 801, 813, 460

[56] References Cited

U.S. PATENT DOCUMENTS

| | | | |
|---|---|---|---|
| 3,161,347 | 12/1964 | Hannon | 206/460 X |
| 3,587,844 | 6/1971 | Wing | 206/554 X |
| 3,915,302 | 10/1975 | Farrelly et al. | 206/813 X |
| 4,064,880 | 12/1977 | Logan | 221/47 X |

FOREIGN PATENT DOCUMENTS

| | | | |
|---|---|---|---|
| 60617 | 2/1948 | Netherlands | 221/47 |
| 1382183 | 1/1975 | United Kingdom | 221/63 |
| 1461410 | 1/1977 | United Kingdom | 221/63 |

*Primary Examiner*—Charles A. Marmor

*Attorney, Agent, or Firm*—John J. Toney; William D. Lee, Jr.; Mark B. Quatt

[57] ABSTRACT

A package of imbricated bags is provided that is adapted for dispensing and opening such bags one at a time. The package includes a chain of adhesively imbricated bags in overlying sequence, each bag being adhesively but releasably attached to adjacent bags and having an open mouth end directed toward the leading end of the chain, and a container for the chain having an elongate, constricted opening through which the leading end of the chain is directed. The length of the opening is less than the bag chain width by a selected extent sufficient to cause the mouth of each bag to open in response to transverse constriction as the chain is advanced through the opening, provided that the width of the opening is sufficiently narrow so as to resistively confront the lower edge of the mouth of a bag being pulled through the opening. A method for making the bag package is also provided.

13 Claims, 4 Drawing Figures

BAG DISPENSING PACKAGE

This application is a continuation of application Ser. No. 452,359 filed on Dec. 23, 1982, now abandoned.

BACKGROUND OF THE INVENTION

This invention relates generally to bag dispensing and more particularly to dispensing imbricated bags in such a way as to permit one at a time removal and opening of such bags.

In the packaging of articles, the efficiency and speed of the overall packaging process is often determined by the ease with which an operator can obtain a bag for use in the packaging process. Because of the importance of dispensing bags to an operator in a packaging process, various techniques have been devised to facilitate and expedite the packaging process. It is highly desirable that the bag dispensing process open each bag as it is removed from the bag supply thereby facilitating handling of the bag as an operator loads or causes to be loaded an article into the dispensed bag. It is the aim of the present invention to provide a method for dispensing and opening bags one at a time from an imbricated chain of bags.

Of general interest concerning the present invention is the disclosure of U.S. Pat. No. 3,161,347 for "Bag Package" issued Dec. 15, 1964 to Hannon, directed to a package of open-ended bags which comprise a supporting member extending longitudinally of the package, a plurality of open-ended bags arranged along the member in an overlying arrangement with a portion of each of the bags being in contact with the member, each of the bags having its opening at the same end of the package with each proceeding bag in a given direction along the member overlying and closing the opening of the following bag, and adhesive means arranged between one side of each of the bags adjacent its opening and the member for temporarily holding the bags to the member.

Of general interest is the disclosure of U.S. Pat. No. 3,587,844 for "Package of Bags" issued June 28, 1971 to Wing, directed to a package of imbricated bags, with each of the bags after the bottom bag being offset forward from the next underlying bag and overlying the opening of the underlying bag. The topside of the underlying bag is attached by an adhesive to the bottom of the overlying bag in sequence. During one at a time removal of bags the lead bag inflates to a relatively square opening when the sequence is positioned with the lead bag on a flat surface.

SUMMARY OF THE INVENTION

There is provided a package of bags adapted for dispensing and opening said bags one at a time, comprising a chain of imbricated bags in overlying sequence, each bag being adhesively but releasably attached to adjacent bags and having an open mouth end directed toward the leading end of said chain; and a container for said chain having an elongate, constricted opening through which the leading end of said chain is directed, the length of said opening being less than the bag chain width by a selected extent sufficient to cause the mouth of each bag to open in response to transverse constriction as said chain is pulled through said opening, the width of said opening being sufficiently narrow so as to resistively confront the lower edge of the mouth of a bag being pulled through said opening.

Additionally, there is provided a method for making a package of bags adapted for dispensing and opening said bags one at a time, comprising forming an imbricated chain of bags in overlying sequence by adhesively but releasably attaching adjacent bags in said chain, the mouths of said bags being directed toward the leading end of said chain; placing said bag chain in a container; and providing for an elongate, constricted opening in said container through which the leading end of said chain is directed, said opening having a length being less than the bag chain width by a selected extent sufficient to cause the mouth of each bag to open in response to transverse constriction as said chain is pulled through said opening, said opening having a width being sufficiently narrow so as to resistively confront the lower edge of the mouth of a bag being pulled through said opening.

BRIEF DESCRIPTION OF THE DRAWINGS

Further details are given below with reference to the drawings wherein.

DESCRIPTION OF THE PREFERRED EMBODIMENTS

Figure 1:
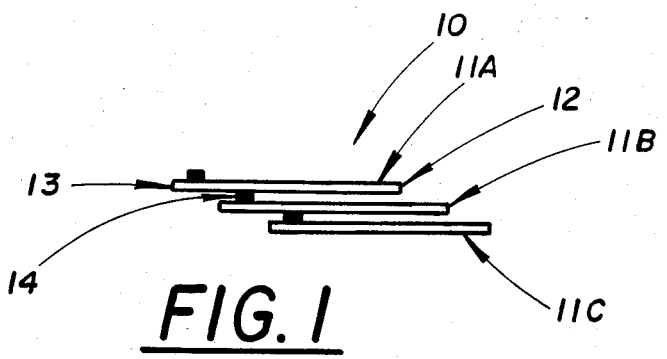
FIG. 1 is a schematic side view of a segment of a chain of adhesively imbricated bags.
Figure 2:
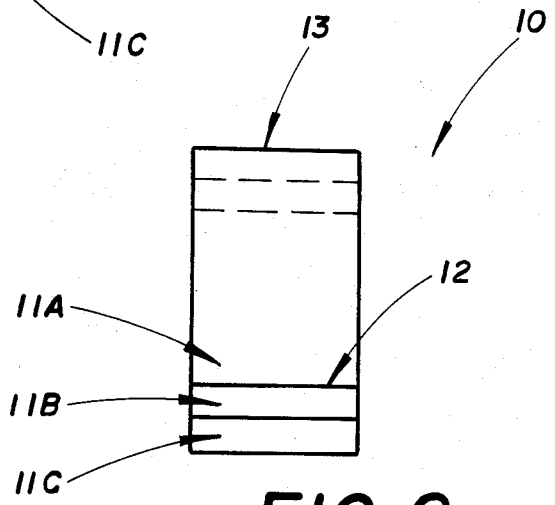
FIG. 2 is a top view of the adhesively imbricated chain of bags.

In FIGS. 1 and 2 a side view and a top view, respectively, are shown of a short segment 10 of a chain of adhesively imbricated bags in overlying sequence. For example, bags 11A,B,C are shown in sequential overlying arrangement. The bags in the chain are substantially identical and are preferably formed in conventional manner from tubular film so that each bag has a bottom end seal and an open end forming the mouth of the bag. The uppermost bag has its mouth towards the leading end of the chain, as do all bags in the chain, so that the weight of overlying bags tends to retain the mouths of the underlying bags closed to prevent debris from entering the bags.

The term "adhesively imbricated chain of bags" refers to a formation of an imbricated or shingled bag series wherein adjacent bags are attached one to another by adhesive patches or spots. This mode of imbrication is disclosed in the Wing patent cited above and is to be distinguished from imbrication of a series of bags on a longitudinal member such as a carrier tape extending the length of the chain as shown for example in the Hannon patent cited above. With the adhesively imbricated mode, a force exerted on the leading bag in the chain is transmitted bag to bag down the chain, while with taped imbricated bags such a force is transmitted along the carrier tape and not bag to bag. Further, with adhesively imbricated bags there is no longitudinal carrier to dispose of during bag dispensing. The significance of these distinctions will become apparent from the discussion given below.

Specifically as indicated in FIG. 1, adhesive glue spots such as that at 14 attach the lower side of an overlying bag to the upper side of the adjacent underlying bag and so on down the chain. The points of adhesion are regularly spaced from the mouth-end of each bag, for example about 1 to 2 inches from the mouth of each underlying bag. Further, the bags are releasably adhered one to another which means that the leading bag of the chain can be separated by pulling obliquely with a relatively small amount of force so as not to substantially disrupt the remainder of the imbricated chain. The adhesive bonding strength and the area of bonding are the main determinates of the ease with which the leading bag may be removed from the chain as discussed in the Wing patent. Representatively, the adhesive may be a noncuring pressure sensitive adhesive applied in a spot of about one square inch or less. Optionally, double-sided adhesive tape may be used in small segments instead of a glue spot. Pressure sensitive adhesives are particularly beneficial when it might be desired to break-up long chains of bags into shorter chains or to join chains of bags together. When a chain of bags is completed the top bag would normally not have any adhesive on its top-side. Thus, when a second chain of bags is to be added to a first chain of bags, it is only necessary to strip the top bag off and press the next bag in the second chain against the last bag in the first chain of bags.

Another parameter of the invention is the extent that adjacent bags in the chain are offset one from another. The offset may range from a small amount, for example three to four inches up to about $\frac{2}{3}$ to $\frac{3}{4}$ of the bag length. The amount of offset is a parameter for optimization in operation of the invention discussed below. It is noted that points of adhesion between adjacent bags will be spaced from the respective overlying bag mouth by an amount greater than the amount of offset between adjacent bags.

Figure 3:
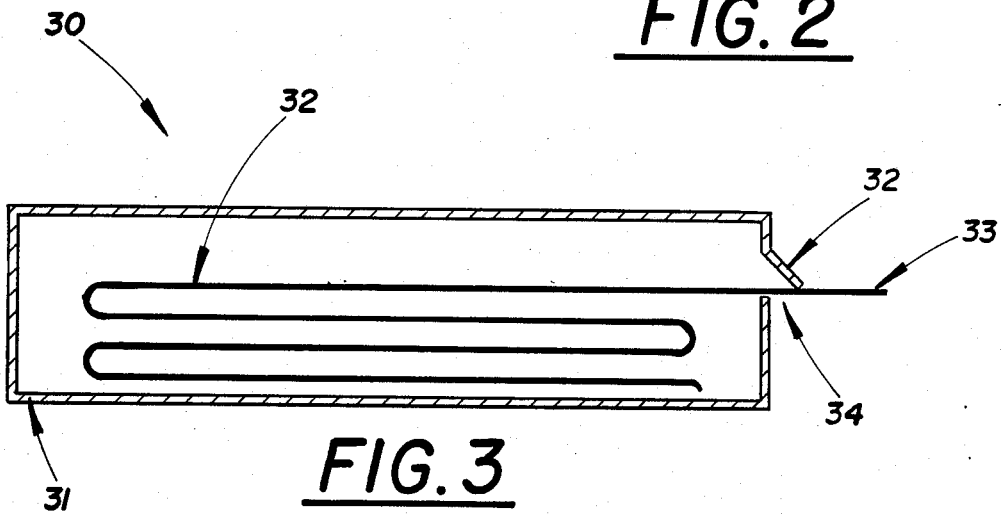
FIG. 3 shows a schematic side cross-section of a container holding a folded chain of imbricated bags with the leading end of the chain being directed through an elongate, constricted opening through which bags are dispensed one at a time from the chain.

In FIG. 3 there is shown a schematic cross-section of a chain of such bags folded in a container with the leading end of the chain being directed through an opening at the side of the container, the configuration being indicated generally by 30. The container 31 is preferably a disposable container such as a cardboard box having a width somewhat greater than the width of the bag chain and a depth sufficient to hold the desired supply of bags. As shown, the container preferably is closed at the top. The bag chain 32 is folded conventionally in a sinuous fashion to fill the container to the desired extent and is oriented such that the leading end of the bag chain at 33 is fed through an opening 34 at the side of container 31, the leading end of the chain being defined as that end of the chain having the uppermost bag in the imbricated bag series. The bag chain 32 is indicated only generally not showing the details of imbrication discussed above.

Figure 4:
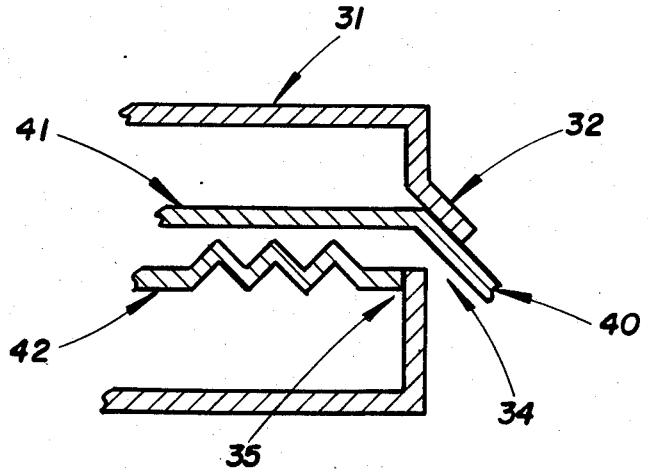
FIG. 4 schematically depicts opening of a bag as the bag chain is pulled through said opening.

In FIG. 4 a detailed view of the opening 34 in container 31 is shown with a bag 40 partially extending through this opening. The opening is generally an elongate opening extending across the side of the container and having a length somewhat less than the width of the bag chain sufficient to exert a transverse constriction on a bag as it is pulled through the opening. For example the elongate dimension of opening 34 is representatively about two inches less than the width of the bag chain. However, it is emphasized that the elongate dimension of the opening 34 is selected so as to optimize the opening effect of this crimping or constriction as a bag is advanced through the opening slot. Further, the width of the opening is selected as quite narrow, being much less than that length of the opening and only somewhat greater than a bag thickness ranging up to about 0.5 inch. The purpose of this width limitation is to cause resistance on a bag passing through the opening as a lead bag having passed the opening is torn from the chain by an operator. The bag 40 is shown as it will be typically configured after the next previous leading bag of the chain has been pulled through opening 34 and torn from the chain, thereby leaving the next leading bag in the opening in a partially opened condition and partially extending from the opening thereby facilitating an operator grabbing that bag and pulling through it the opening for removal from the chain. The lower side 42 of bag 40 resistively confronts the lower edge of opening 34 as indicated at 35 since the leading bag pulls on the upper side 41 of bag 40 thereby pulling the mouth-end of that side through the opening, while lower side 42 having no direct force urging it through the opening tends to snag at 35.

Preferably, opening 34 has flap 32 which tends to urge or deflect bag 40 downward toward the lower edge 35 of opening 34 thereby enhancing the tendency of lower bag side 42 to snag at 35 to partially open bag 40 for its convenient removal when the operator is ready. The opening 34 may be made quite simply. For example, when the container 31 is a cardboard box an elongate slit may be made across one end of the container and vertical cuts may be made at the ends of the transverse slit to form flap 32. This slit will have the configuration generally of an elongate lower profile U or H. As an optional feature, the extent of resistance at location 35 may be selectively varied by providing a friction reducing element (not shown) at location 35, such as a teflon coated guide.

It is noted that because the chain of imbricated bags is not imbricated on a longitudinal carrier but rather is imbricated bag-to-bag, force transmission down the chain of bags is bag-to-bag rather than along the carrier member which makes possible the shearing motion between upper side 41 and lower side 42 of representative bag 40 as indicated in FIG. 4. Thus, in attempting to dispense taped imbricated bags from the device, it is observed that such bags are merely pulled through the elongate opening with little or no opening effect. Once a bag has been advanced through opening 34 it is then removed from the bag chain by exerting a tearing motion on the advanced leading bag by obliquely pulling the bag across the chain which releases from the chain at the point of adhesion since the adhesive binding force is relatively small, as discussed above.

Although the present invention has been described in conjunction with preferred embodiments, it is to be understood that modifications and variations may be utilized without departing from the principles and scope of the invention, as those skilled in the art will readily understand. Accordingly, such modifications and variations may be practiced within the scope of the following claims.

What is claimed is:

1. A package of bags adapted for dispensing and opening said bags one at a time, comprising:

(a) a chain of imbricated bags in overlying sequence, each bag being adhesively but releasably attached to the upper side of the next adjacent bag, each bag having an open mouth end directed toward the leading end of said chain, each bag overlying the mouth of the next adjacent bag: and, (b) a container for said chain having an elongate, constricted opening through which the leading end of said chain is directed, the length of said opening being less than the bag chain width by a selected extent sufficient to cause the mouth of each bag to open in response to transverse constriction as said chain is pulled through said opening, the width of said opening being sufficiently narrow so that the lower edge of the opening resistively confronts the lower edge of the mouth of a bag being pulled through said opening whereby as the leading bag is pulled through the opening is pulls on the upper side of the next adjacent bag thereby pulling the mouth-end of said upper side through the opening while the lower side confronts the lower edge of the opening.

2. The bag package of claim 1 wherein adjacent bags are attached by a spot of a noncuring pressure sensitive adhesive.

3. The bag package of claim 1 wherein the point of adhesion between adjacent bags is about 1 to 2 inches from the mouth-end of the respective underlying bag.

4. The bag package of claim 1 further comprising menas for downwardly deflecting a bag being pulled into said opening.

5. The bag package of claim 4 wherein said deflecting means is a flap over said opening.

6. The bag package of claim 5 wherein said opening is a cut in a form selected from the group consisting of a U or H of elongate low profile.

7. The bag package of claim 4 wherein the elongate dimension of said opening is about 2 inches less than the width of said bag chain.

8. A method for making a package of bags adapted for dispensing and opening said bags one at a time, comprising:

(a) forming an imbricated chain of bags in overlying sequence by adhesively but releasably attaching each bag to the upper side of the next adjacent bag in said chain, the mouths of said bags being directed toward the leading end of said chain, each bag overlying the mouth of the next adjacent bag;

(b) placing said bag chain in a container; and (c) providing for an elongate, constricted opening in said container through which the leading end of said chain is directed, said opening having a length being less than the bag chain width by a selected extent sufficient to cause the mouth of each bag to open in response to transverse constriction as said chain is pulled through said opening, said opening having a width being sufficiently narrow so that the lower edge of the opening resistively confronts the lower edge of the mouth of a bag being pulled through said opening whereby as the leading bag is pulled through the opening it pulls on the upper side of the next adjacent bag thereby pulling the mouth-end of said upper side through the opening while the lower side confronts the lower edge of the opening.

9. The method in claim 8 further comprising attaching adjacent bags within said chain by a spot of a noncuring pressure sensitive adhesive.

10. The method of claim 8 further comprising adhering adjacent bags within said chain at a point about 1 to 2 inches from the mouth-end of the respective underlying bag.

11. The method of claim 8 further comprising providing for downward deflection of a bag as it is pulled through said opening.

12. The method of claim 11 further comprising forming said opening by a cut in the form selected from the group consisting of a U or H of elongate low profile.

13. The method of claim 11 wherein the said opening is formed so that its elongate dimension is about 2 inches less than the width of said bag chain.

* * * * *